US005724697A

United States Patent [19]

Klee et al.

[11] Patent Number: 5,724,697

[45] Date of Patent: Mar. 10, 1998

[54] TOOTHBRUSH CONSTRUCTION

[75] Inventors: Martin Howard Klee, Highland Park; Francis Patrick Paciullo, Branchburg, both of N.J.

[73] Assignee: Colgate-Palmolive Company, New York, N.Y.

[21] Appl. No.: 692,818

[22] Filed: Aug. 2, 1996

[51] Int. Cl.[6] ..... A46B 3/16

[52] U.S. Cl. ..... 15/205; 15/167.1; 15/195

[58] Field of Search ..... 15/167.1, 190, 15/191.1, 195, 197, 199, 204, 205

[56] References Cited

U.S. PATENT DOCUMENTS

| | | | |
|---|---|---|---|
| 123,064 | 1/1872 | Van Kleeck . | |
| 196,802 | 11/1877 | Hill | 15/190 |
| 378,130 | 2/1888 | Gane . | |
| 378,132 | 2/1888 | Gane . | |
| 447,996 | 3/1891 | Young . | |
| 503,795 | 8/1893 | Kimball . | |
| 532,735 | 1/1895 | Kimball . | |
| 682,836 | 9/1901 | Arnold | 15/205 |
| 725,269 | 4/1903 | Mobius . | |
| 730,680 | 6/1903 | Page . | |
| 734,625 | 7/1903 | Smith . | |
| 788,714 | 5/1905 | Flemming . | |
| 1,014,973 | 1/1912 | Page . | |
| 1,055,607 | 3/1913 | Chandler | 15/205 |
| 1,058,499 | 4/1913 | Vanderveld . | |
| 1,070,860 | 8/1913 | Vanderveld . | |
| 1,115,165 | 10/1914 | Briggs . | |
| 1,601,217 | 9/1926 | Jones . | |
| 1,828,422 | 10/1931 | Levy . | |
| 1,879,103 | 9/1932 | Connor . | |
| 1,919,010 | 7/1933 | Connor . | |
| 1,936,743 | 11/1933 | Zahorandsky . | |
| 1,957,363 | 5/1934 | Snell . | |
| 1,972,691 | 9/1934 | Nishio . | |
| 2,084,345 | 6/1937 | Jobst . | |
| 2,209,173 | 7/1940 | Russell . | |
| 2,329,471 | 9/1943 | King . | |
| 2,409,490 | 10/1946 | Jobst . | |
| 2,686,495 | 8/1954 | Hutton . | |
| 2,796,622 | 6/1957 | Kalinowski . | |
| 2,896,285 | 7/1959 | Morin . | |
| 3,284,258 | 11/1966 | Patti et al. . | |
| 4,481,702 | 11/1984 | Mitchell . | |
| 5,459,898 | 10/1995 | Bacolot . | |
| 5,590,438 | 1/1997 | Chen et al. | 15/195 |

FOREIGN PATENT DOCUMENTS

| | | | |
|---|---|---|---|
| 591887 | 1/1934 | Germany | 15/190 |
| 482222 | 3/1938 | United Kingdom | 15/190 |

*Primary Examiner*—Terrence Till
*Attorney, Agent, or Firm*—Richard J. Ancel

[57] ABSTRACT

A novel toothbrush staple for a holding a U shaped tuft of bristles in a tuft hole of a toothbrush head. The staple is generally flat and its lower edge is rounded to inhibit rupturing the bristles at the bight portion of a U shaped tuft of bristles mounted by the staple in the hole. The sides of the staple are provided with one or more horizontal grooves each having a sharp edge. The arrangement of tufts and staple is such that the rounded bottom of the staple contacts the bight portion of the tuft of bristles, thus precluding rupture due to sharp edges at the staple bottom bearing against the bight portion of the tufts, especially during initial installation of the tuft in the hole. Each leg of the U shaped tuft is in contact with a respective staple surface. With the passage of time, plastic creep or flow results in the plastic on the inside wall of the hole flowing towards the staple sides and interlocking with the sharp edges of the grooves. Instead of an elongated groove having a sharp edge on each of the opposite major surfaces of the staple, these surfaces may be provided with knurlings. Further, the elongated grooves may intersect as well as being parallel, and may be of generally U shape in transverse section.

8 Claims, 4 Drawing Sheets

TOOTHBRUSH CONSTRUCTION

BACKGROUND OF THE INVENTION

This invention relates to improved staples or anchors used to hold tufts of bristles in the tuft holes of brushes, especially toothbrushes.

Typically, in the conventional manufacturing process for brushes, particularly toothbrushes, the brushes are injection molded with empty tuft holes in the toothbrush head. The tuft holes may also be drilled after the injection molding as well as initially formed in the head concurrently with the injection molding. In a secondary operation, U shaped tufts of bristles are inserted into the holes in the head. Each tuft of bristles is held in place by a generally rectangular staple that is wider than the tuft hole so that when the staple is used to drive the U-shaped tufts into the staple hole, the edges of the staple slightly cut and deform the sides of the hole. The pressure and resulting static friction of the surrounding plastic on the staple contributes to forces maintaining the staple in place. However, there are certain problems associated with brushes made in this manner. Specifically, bristles may occasionally come out of the tuft holes during brushing by a consumer. One reason for this is that the staples are generally rectangular in shape and their bottom, narrow ends, having sharp edges, if driven too far into the tuft holes, may partially sever or at least weaken some of the U-shaped bristles at the bight portion of each tuft, thereby permitting breaking of at least some of the bristles when brushing forces are applied, so that some of the bristles come out of respective tuft holes. Further, staples occasionally loosen, again resulting in the an entire tuft coming out of a respective tuft hole. The staple or anchor art has had to deal with these problems in a variety of ways.

Recently toothbrush staples of the rectangular type have become available in which at least one of the major faces or surfaces thereof is provided with parallel grooves, thereby yielding a staple that has been found to be more resistant to becoming separated from its tuft hole than staples with smooth surfaces. While substantially solving the problem of staple dislodgement, this parallel groove construction has not solved the problem of bristle severance due to tuft weakening by the sharp bottom edges of the staples.

Typically, staple wire is formed by deforming a round wire, typically taken off a drum, to a flattened configuration. In the production of most toothbrushes, the flattened wire is then cut to a desired length on a tufting or bristling machine to define the individual staple. Recently, however, a staple has become available in which one of the major surfaces is provided with parallel grooves, and the flattened wire is then cut to the desired length on a tufting machine to define individual staples.

SUMMARY OF THE INVENTION

According to the practice of this invention, the problem of tuft weakening and possible rupture of filaments or bristles forming the U shaped tufts accompanying staple and tuft insertion is solved by forming the lower or leading edge of the staples so that this edge has rounded corners. With such a rounded construction, the zone or area of contact of the lower staple edge with any filament in the tuft closely matches the U shape at the bight portion of each tuft. In turn, this permits the staples to be driven deeper into the handle and thus applying a larger and more consistent force on each U shaped tuft without cutting or damaging the filaments.

Further according to the invention both major side surfaces of the staple are provided with longitudinally running grooves, each staple thus having a transverse sawtooth cross section whose grooves present sharp edges to the facing surfaces of each tuft receiving hole. It is believed that plastic creep, taking place over a relatively long period of time, results in the flow of plastic from which the head is formed. This flow or movement from the hole sides is at least partially toward the barbed grooves in the staple sides, resulting in an interlocking of the staples with the plastic adjacent the hole interior regions. The use of sharp or barbed edges yields a superior gripping action. Instead of barbed channels on the staple major sides, knurled surfaces may be provided on one or both major sides.

DETAILED DESCRIPTION OF THE INVENTION

Figure 1:
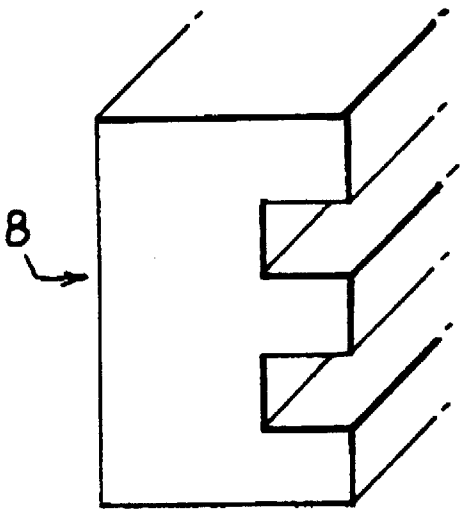
FIG. 1 (PRIOR ART)
FIG. 1 is a partial perspective end view of a known toothbrush staple.

Referring now to FIG. 1, a known toothbrush staple is designated generally as 8 and includes a plurality of square ridges and channels on one major face or surface. The staple is illustrated as lying in a vertical plane with the right hand major surface having the horizontally running ridges and grooves.

Figure 2:
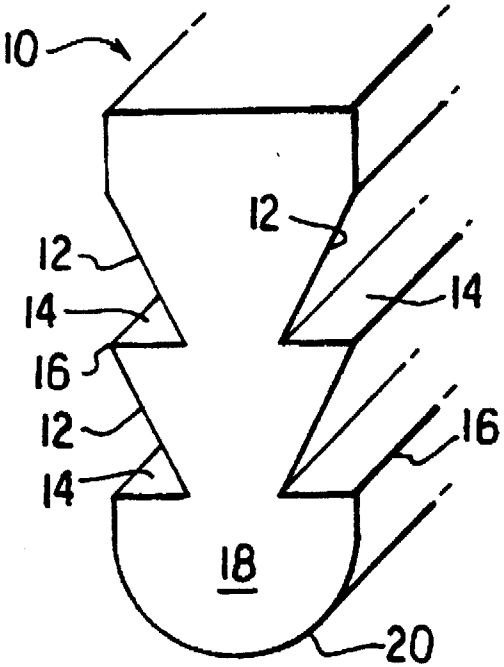
FIG. 2 is a view similar to FIG. 1 and illustrates a toothbrush staple according to a first embodiment of this invention.

Referring now to FIG. 2 of the drawings, the novel toothbrush staple of this invention is designated generally as 10 and is also shown as lying in a vertical plane. Each of the two opposite major surfaces of the staple is provided with a plurality of horizontally extending grooves triangular in transverse section having inwardly or centrally extending slanting surfaces 12 and flat or horizontal surfaces 14. The intersection of surfaces 12 and 14 defines horizontally extending edges 16. The lower edge of staple 10 is rounded in a generally semi-circular form and is denoted by 20.

Figure 3:
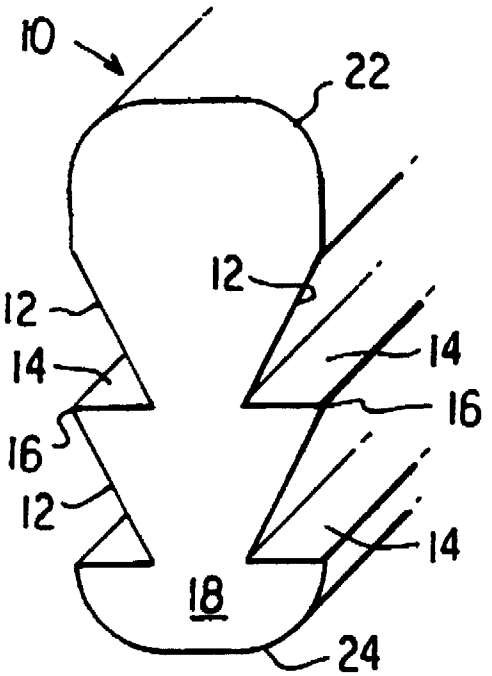
FIG. 3 is a view similar to FIG. 1 and illustrates a toothbrush staple of this invention according to a second embodiment of this invention.

Referring now to FIG. 3, another embodiment of the novel toothbrush staple of this invention is illustrated, and differs essentially from that shown at FIG. 2 in that the upper edge of the staple is rounded, as indicated by 22, while the lower edge of the staple is also rounded at region 18, but to a flatter, more semi elliptical than semi circular, extent than is shown in FIG. 2.

Figure 4:
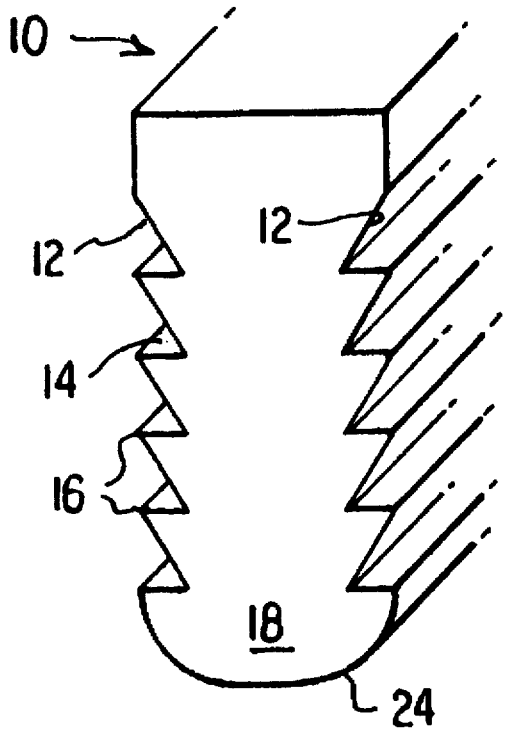
FIG. 4 is a view similar to FIG. 1 and illustrates a toothbrush staple of this invention according to a third embodiment of this invention.

FIG. 4 shows another embodiment of the novel staple of this invention, and is similar to that of FIG. 2, except that the number of horizontally running grooves of triangular transverse section on the two opposite major surfaces of the staple is increased and the grooves are not as deep as that shown in Figure 2.

Figure 5:
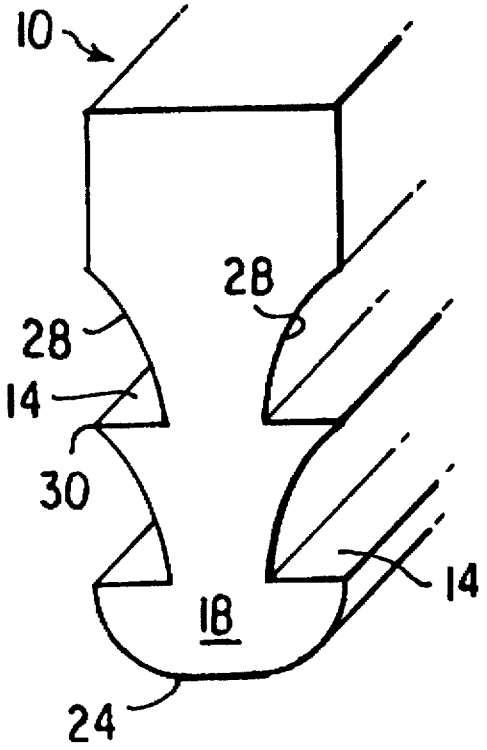
FIG. 5 is a view similar to FIG. 1 and illustrates a toothbrush staple of this invention according to a fourth embodiment of this invention.

Referring now to FIG. 5 of the drawings, another embodiment of the toothbrush staple of this invention is illustrated, and is similar to that shown at FIG. 2, except that the inward, slanting portions of each groove, designated as 28, are curved instead of straight, and further the horizontally extending edges, denoted as 30, are of a curved or fish hook configuration.

The formation of staples 10 may be carried out by passing a wire of indefinite length through the nip of metal rollers to deform the wire from a rounded to a relatively flat transverse cross section. Next the flattened wire is passed through the nip of another set of metal rolls, having continuous ribs on their peripheral surfaces, so as to deform the opposite major surfaces of the flattened wire and thus produce the parallel and horizontal saw tooth type grooves having inwardly slated surfaces 12 or rounded surfaces 28, together with flat groove regions 14. The facing nip surfaces of the rolls may, alternatively, be provided with knurled surfaces to deform the wire to produce knurls on the opposite major staple surfaces. Alternatively, metal pressing dies, movable towards and away from each other, may be employed to deform the flattened wire to thus yield the parallel grooves or the knurlings on the opposite, major faces. The second deforming step may also include the deforming of one edge of the flattened wire to assume a rounded shape, such as indicated by 20 or 24 in the drawings. Thereafter, the now deformed wire is cut to desired lengths to form staples 10.

After initial installation, it has been observed that plastic creep or flow will cause interior walls of hole 42 which are opposite the two elongated grooved major faces of the staple to flow inwardly towards the grooves resulting, after a period of time, a secure lock between the horizontal grooves of the staple, on both of its major surfaces, and the plastic of the toothbrush head is formed.

Figure 6:
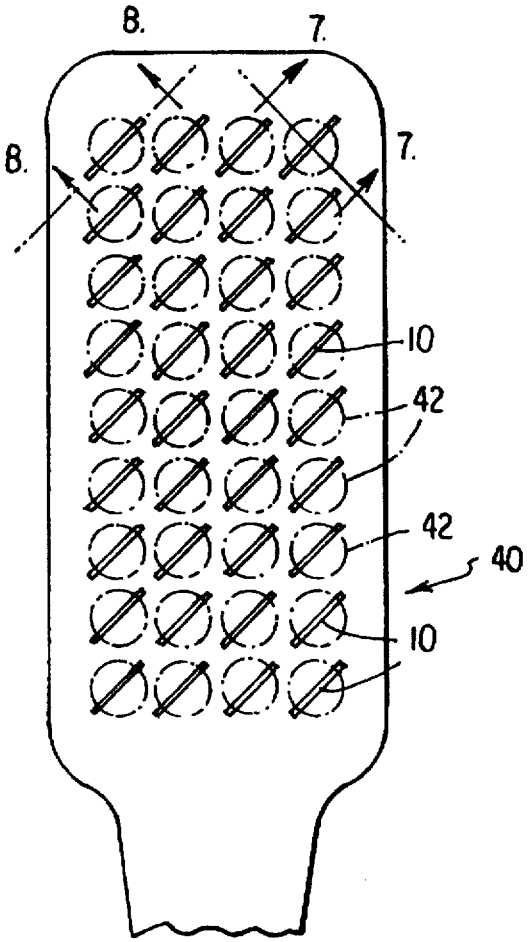
FIG. 6 is a top plan view of a toothbrush head provided with the staples of this invention, the bristles not shown.
Figure 7:
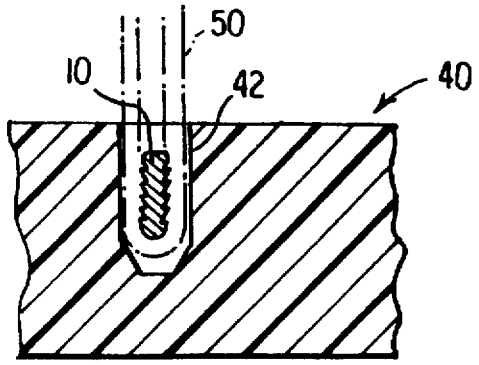
FIG. 7 is a view taken along section 7—7 of FIG. 6 and shows, in phantom, a tuft of bristles held within a head hole by a staple of this invention.
Figure 8:
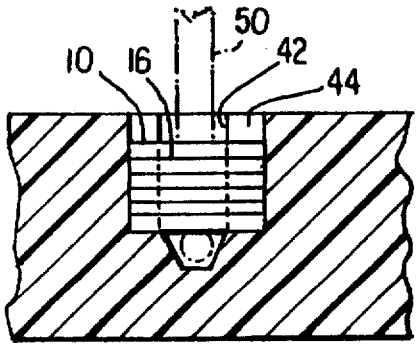
FIG. 8 is a view taken along section 8—8 of FIG. 6 and shows, in phantom, a tuft of bristles held within a head hole by a staple of this invention.

The individual tufts of bristles are formed into U shape by known apparatus/techniques and are placed into individual holes in the toothbrush head, as illustrated in FIGS. 6 to 8.

FIG. 6 shows a staple 10 of this invention in each of a plurality of holes 42 in toothbrush head 40 (typically of a polymer material), each hole extending downwardly from the top surface of the head. The two ends of each staple 10 are seen to extend slightly into opposite regions of each hole. The rotational orientation of the plane which contains each staple is not critical, i.e., the staple may be installed by rotating it, before installation, about its central vertical axis differently from the rotational orientation of about 45 degrees shown at FIG. 6 to assume any desired orientation.

In FIGS. 7 and 8, taken 90 degrees from each other, illustrate a typical tuft 50, shown in phantom lines, as bent into a U shape. The bight or curved part of the U is contacted by the bottom of staple 10 while the two legs of the U extend upwardly and define the visible bristles of the toothbrush. The opposite portions of each hole 42 into which the ends of the staple extend are denoted as 44, these latter portions made upon forcing the staple into the hole and deforming the plastic from which head 40 is formed.

Figure 9:
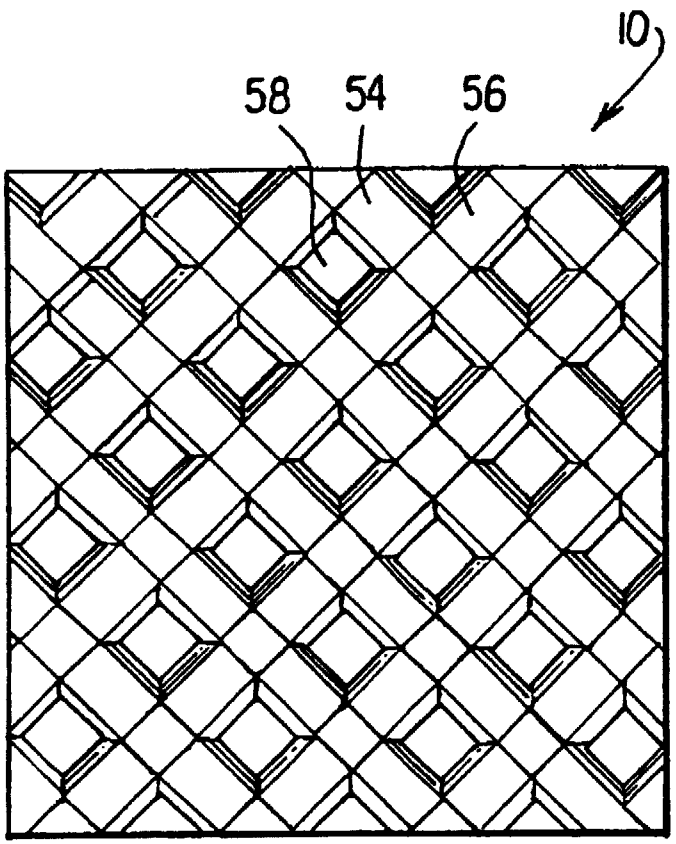
FIG. 9 is a side elevational view of a staple according to a fifth embodiment of this invention.

FIG. 9 shows an embodiment wherein at least one side surface of a staple 10 is provided with a first set 54 of slanted grooves and a second set of slanted grooves 56, these two sets intersecting at about 90 degrees to form shallow posts 58 at the intersections of the individual grooves. FIG. 9 thus shows a diamond like pattern.

Figure 10:
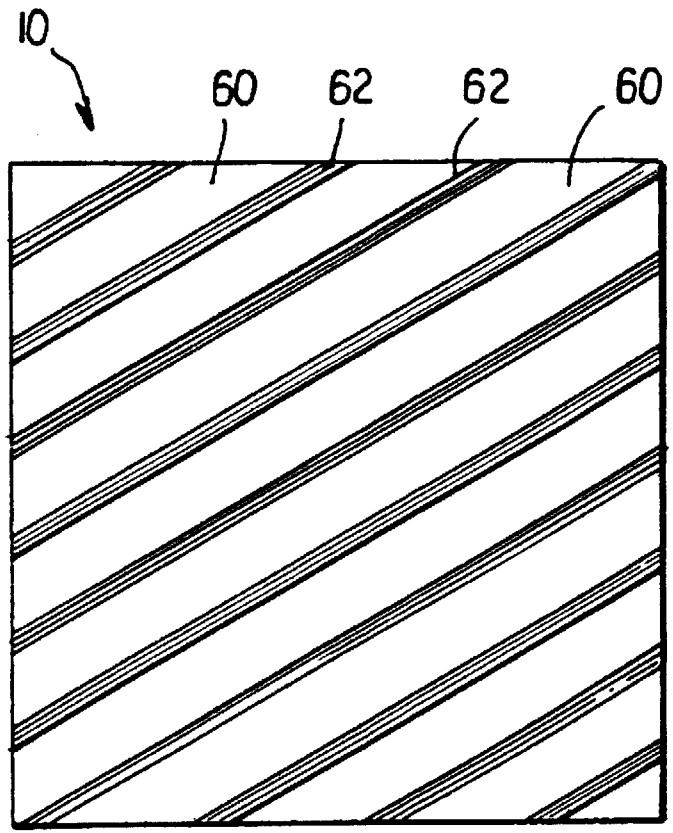
FIG. 10 is a side elevational view of a staple according to a sixth embodiment of this invention.

In the embodiment of FIG. 10, at least one side surface of a staple 10 is provided with a set of slanted grooves 60, each groove having bordering ridges 62. FIG. 10 thus shows a slanted or diagonal pattern. The action of plastic creep which retains the staples in place, earlier described, is the same for the patterns of both FIGS. 9 and 10.

Geometrical terms of orientation, such as horizontal and the like, are employed to facilitate the description.

We claim:

1. A toothbrush head staple and tuft construction for holding a U-shaped tuft of bristles in said head, said head having an upper surface and a hole extending downwardly from said head upper surface, said tuft of bristles having a bight portion and having vertically extending legs, said tuft of bristles located in said hole in said head, the legs of the U-shaped tuft extending substantially vertically upward from said bight portion and extending beyond said head upper surface, said staple being generally flat and lying in a vertical plane and having opposed major sides and a bottom edge, one of said major sides of said staple being providing with roughened areas, said bottom edge bearing against said tuft bight portion and being rounded where said bottom edge contacts said tuft bight portion, said staple having vertically extending edges which engage diametrically opposing portions of said hole, said tuft bight portion located within said hole, whereby the tendency of said bottom edge of said staple to weaken the tuft at said tuft bight portion is lessened.

2. The toothbrush head construction of claim 1 wherein said roughened areas are in the form of knurls.

3. The toothbrush head construction of claim 1 wherein at least one of said major sides of said staple is provided with horizontal grooves which are substantially triangular in transverse section.

4. The toothbrush head construction of claim 3 wherein said grooves have downwardly slanting wall portions and flat portions.

5. The toothbrush head construction of claim 4 wherein said grooves have downwardly slanting wall concave portions and flat portions.

6. The toothbrush head construction of claim 5 wherein said flat portions have downwardly curved edges.

7. The toothbrush head construction of claim 1 wherein at least one of said major sides of said staple is provided with parallel slanting horizontal grooves.

8. The toothbrush head construction of claim 1 wherein at least one of said major sides of said staple is provided with intersecting grooves.

* * * * *